US007950540B2

(12) United States Patent
Bara

(10) Patent No.: US 7,950,540 B2
(45) Date of Patent: May 31, 2011

(54) APPARATUS FOR SECURING TUBES

(76) Inventor: Nicolas Bara, Paris (FR)

( * ) Notice: Subject to any disclaimer, the term of this patent is extended or adjusted under 35 U.S.C. 154(b) by 801 days.

(21) Appl. No.: 10/585,913

(22) PCT Filed: Jan. 14, 2005

(86) PCT No.: PCT/FR2005/000090

§ 371 (c)(1),
(2), (4) Date: Nov. 30, 2006

(87) PCT Pub. No.: WO2005/073102

PCT Pub. Date: Aug. 11, 2005

(65) Prior Publication Data

US 2008/0093362 A1 Apr. 24, 2008

(30) Foreign Application Priority Data

Jan. 15, 2004 (FR) ..... 04 00358

(51) Int. Cl.
*B65D 50/08* (2006.01)
*B65D 39/00* (2006.01)
*B65D 21/02* (2006.01)

(52) U.S. Cl. ..... 215/209; 215/230; 215/253; 215/901; 220/23.86; 220/23.89; 220/737

(58) Field of Classification Search ..... 220/265, 220/740, 737, 742; 215/209, 230, 251, 253, 215/257, 258, 273, 395, 901
See application file for complete search history.

(56) References Cited

U.S. PATENT DOCUMENTS

| | | | | | |
|---|---|---|---|---|---|
| 1,162,615 | A | * | 11/1915 | Keislar | 215/49 |
| 2,763,395 | A | * | 9/1956 | Meek | 220/8 |
| 3,794,098 | A | * | 2/1974 | Versen | 152/428 |
| 4,724,972 | A | * | 2/1988 | Marcus | 215/223 |
| 5,230,427 | A | | 7/1993 | Betts et al. | |
| 5,257,704 | A | * | 11/1993 | Gutt | 215/246 |
| 5,605,230 | A | * | 2/1997 | Marino et al. | 206/534 |

FOREIGN PATENT DOCUMENTS

| | | | |
|---|---|---|---|
| EP | 0 344 966 | A1 | 12/1989 |
| GB | 2 089 327 | A | 6/1982 |
| GB | 2 263 107 | A | 7/1993 |
| GB | 2 366 790 | A | 3/2002 |
| JP | 08-119653 | | 5/1996 |

* cited by examiner

*Primary Examiner* — Anthony Stashick
*Assistant Examiner* — Madison L Wright
(74) *Attorney, Agent, or Firm* — DLA Piper LLP (US)

(57) ABSTRACT

An apparatus for securing containers for receiving and preserving biological specimens comprising a plug that comprises at least one connecting means such that, after interlocking with the apparatus, access to contents of the apparatus necessarily brings about a physical transformation that is irreversible and can be ascertained by the naked eye of the container, and not of the plug, which physical transformation consists, e.g., but not necessarily, of a rupture or a tear of this means.

18 Claims, 5 Drawing Sheets

APPARATUS FOR SECURING TUBES

RELATED APPLICATION

This is a §371 of International Application No. PCT/FR2005/000090, with an international filing date of Jan. 14, 2005 (WO 2005/073102 A1, published Aug. 11, 2005), which is based on French Patent Application No. 04/00358, filed Jan. 15, 2004.

TECHNICAL FIELD

This disclosure relates to the area of the collection and preservation of biological specimens. More particular aspects relate to a sleeve apparatus that allows cryotubes to be secured that can contain, e.g., blood samples or tissue samples.

BACKGROUND

A cryotube is a cylindrical plastic container classically composed of two elemental pieces: the tube and the plug. The tightness of the assembly of these two pieces (generally by screwing) permits preservation of specimens inside the cryotube at variable temperatures that can drop according to the models down to −196° C. (liquid nitrogen), whence the term "cryo" tube.

Tubes that can contain specimens to be frozen under liquid nitrogen are known.

SUMMARY

This disclosure relates to an apparatus for securing containers for receiving and preserving biological specimens including a plug that includes at least one connecting means such that, after interlocking with the apparatus, access to contents of the apparatus necessarily brings about a physical transformation that is irreversible and can be ascertained by the naked eye of the container, and not of the plug, which physical transformation consists, e.g., but not necessarily, of a rupture or a tear of this means.

This disclosure relates to an apparatus for securing containers for receiving and preserving biological specimens including a plug that includes at least one connector such that, after interlocking with the apparatus, access to contents of the apparatus necessarily brings about a physical transformation that is irreversible and can be ascertained by the naked eye of the container, and not of the plug, which physical transformation consists, e.g., but not necessarily, of a rupture or a tear of this connector.

BRIEF DESCRIPTION OF THE DRAWINGS

This disclosure will be better understood with the aid of the description, given in the following solely by way of explanation, of a selected aspect with reference made to the attached figures in which.

DETAILED DESCRIPTION

Figure 1:
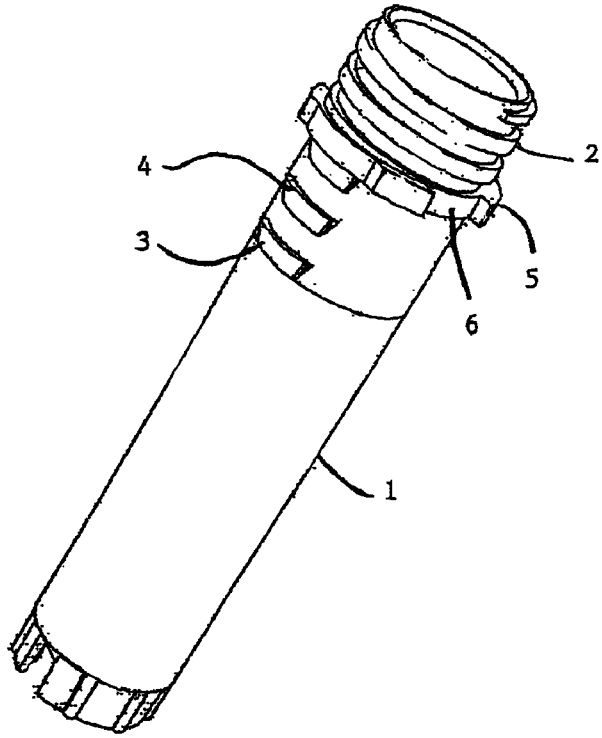
FIG. 1 shows a view of a tube for containing specimens.

I have added a third piece to the tube-plug couple: a securement sleeve. This piece is called a "sleeve."

Securement of the tubes for the collecting and preserving of specimens includes the following elements:

- Improvement of the physical integrity of the specimen once the tube is closed (rendering the specimen substantially inviolable at a high level of security, definitive and non-replaceable indicator of violation integral with the container and not with the plug);
- Improvement of the integrity of the empty tube: good closure, of the sterility and of the emptiness of the interior of the cryotube before use;
- Improvement of the unique and inalterable identification of the tube and, therefore, of the specimen that it contains (non-identified specimen =lost specimen); and
- Improvement in anonymity of the specimen.

In contrast, prior cryotubes do not respond or respond in a very incomplete or partial manner to the totality of these security requirements.

Securing cryotubes is becoming more and more important given the increasingly central part played by analysis in the area of forensic medicine, for example. DNA analyses, for example, are used instead of evidence in more and more cases. The use of secure containers (sampling, traceability and preservation) is therefore now required if the user (the justice system in this instance) desires to have specimens that are physically and legally reliable.

My advance has therefore made available a maximum degree of security corresponding to the improved levels described above. Thus, I have developed an apparatus for securing a container for collecting and preserving biological specimens comprising a plug that comprises at least one means such that after the interlocking of the apparatus, any access to the contents of the apparatus necessarily brings about a physical transformation, that is irreversible and can be ascertained by the naked eye, of this container (and not of the plug), which physical transformation comprises, e.g., but not necessarily, of a rupture or a tear of this means.

The security device can preferably be interlocked at any moment at the will of the user.

The means is advantageously integral with the apparatus.

The means is preferably a divisible clamp (lug, flap or the like).

The apparatus can not be disassociated from the container.

Interlocking of the apparatus is advantageously made by irreversibly driving the container into the apparatus.

The apparatus and the container are preferably made of different materials.

The apparatus is advantageously composed of a material that allows engraving an indelible and unitary identification.

The apparatus may be composed of a material that allows reading of the elevated contrast engraving.

The means may be a tongue that can be integrated in a definitive and non-replaceable manner with the apparatus and the plug.

Integration of the tongue may be carried out with an adhesive band that can not be violated by tearing.

Integration of the tongue may be carried out by welding.

The apparatus also advantageously comprises a housing that allows insertion of a physical element containing at least one piece of information associated with the contents.

Insertion is therefore preferably carried out without masking the identification engraving and in an irreversible manner.

The insertion is preferably carried out in an irreversible manner.

It will be appreciated that the following description is intended to refer to specific embodiments of the invention selected for illustration in the drawings and is not intended to define or limit the invention, other than in the appended claims.

In FIG. 1, tube 1 suitable for receiving specimens is a cold-resistant container of polypropylene (PP) or the like. It is provided with outer screw thread 2 and a system of definitive interlocking at two levels of the sleeve (one-way assembly).

The first catch 3 is an assembly catch serving to integrate the sleeve to the tube in a definitive manner (one way).

The second catch 4 is an interlocking catch of the apparatus for rendering the tube inviolable by divisible clamps with the sleeve. This first degree of security will be called "first-degree securement" or "first-degree inviolability".

Any collars 5 of the tube have undercuts (incisions) 6 necessary for the passage of the various inviolability apparatuses in interlocked position.

Figure 2:
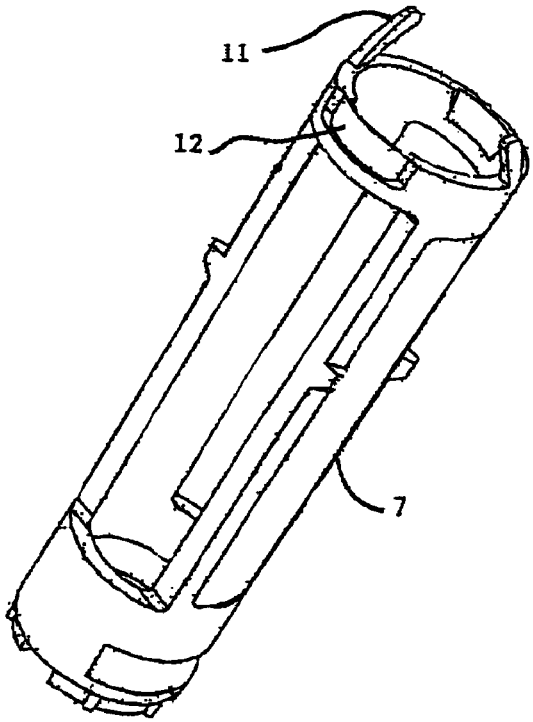
FIGS. 2 and 3 show a securement sleeve with or without a plug.
Figure 3:
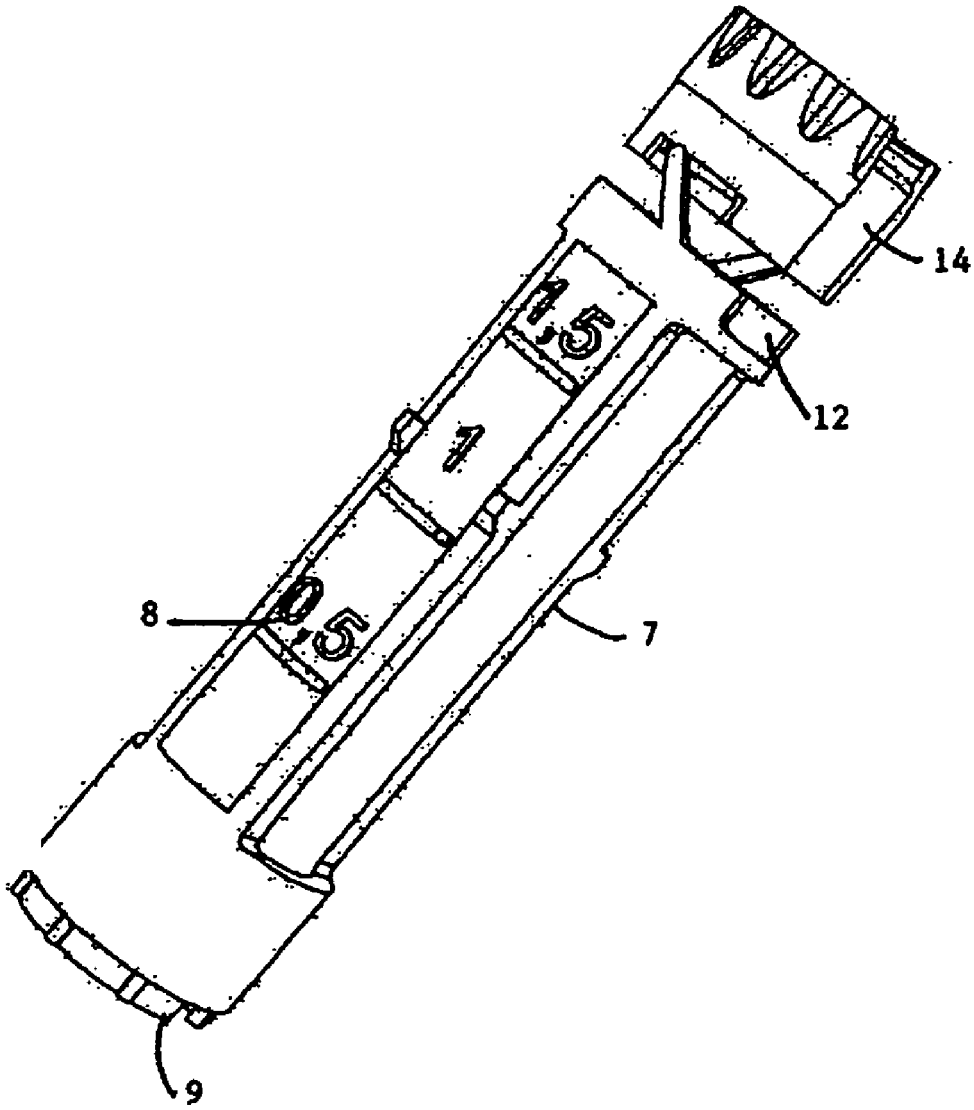

In FIGS. 2 and 3, sleeve 7 is constituted of any rigid material, e.g., polyamide (PA) or the like. It should be noted that it is not in contact with the specimens. The specifications of the tubes and of the sleeves are very different and at times divergent.

This allows the free addition, directly on the sleeve, of any marking or securement additive. Thus, if the markings by labels in the liquid are not satisfactory, it is possible to mark the sleeve with a laser for an inalterable authentication.

It is preferably more practical for the manipulations to see the specimen or its level. A volume mark or other mark 8 is then engraved in the mold directly on the sleeve. This system allows expensive marking steps to be avoided.

The sleeve has, e.g., label zones or laser-marking zones.

The sleeve bottom may be flat and smooth to be able to be engraved on the lower part of the sleeve. Moreover, the sleeve may be provided with hook system 9 for an automatic screwing. Furthermore, it may have a lateral drawer for collecting a physical element carrying information relative to the specimen, e.g., a radio frequency chip (RFID). It is on the side so not to hide the marking zones under the sleeve.

Figure 8:
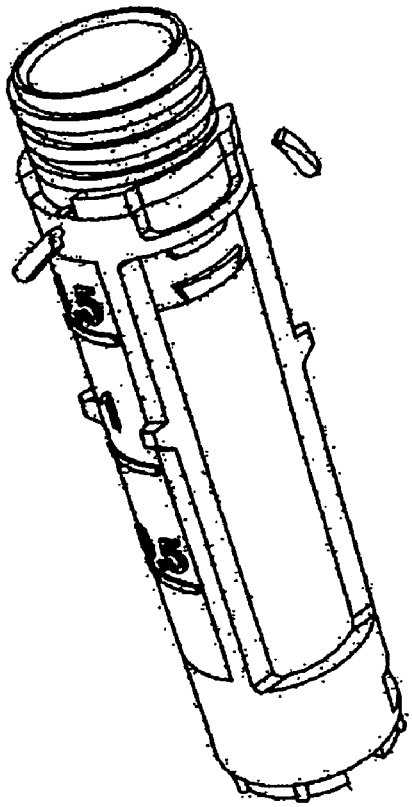
FIG. 8 shows a sleeve after breaking of a divisible security clamp.

It also comprises an essential security element in the form of an element whose rupture is irreversible, representing the first degree of securement. This element is preferably a divisible clamp 11 integral with the sleeve. The characteristics of the clamp are such that it breaks when the plug is opened if the securement system is interlocked, as illustrated in FIG. 8.

Furthermore, the sleeve contains a zone 12 suitable for receiving and retaining in vertical position without excessive thickness (with a flush contour) any tongue integrated conjointly with the sleeve and the plug.

The tongue can be integrated with the sleeve by various means such as, e.g., by welding or by an inviolable adhesive band of a known type.

Figure 4:
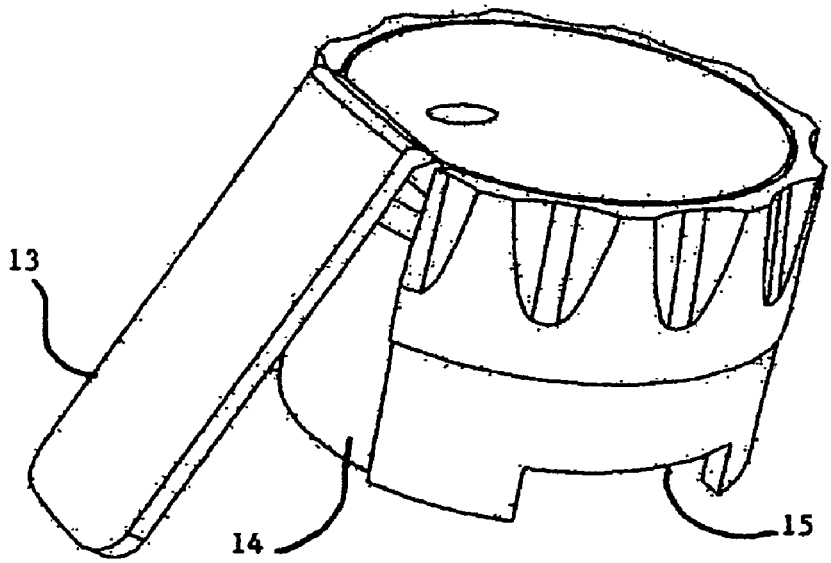
FIG. 4 shows a plug associated with a securement sleeve provided with a security tongue.

As is shown in FIG. 4, the plug is a covering screw plug provided with a flexible joint to ensure the tightness in the liquid nitrogen or in the nitrogen vapor.

It is provided with an automatic screwing apparatus by upper latching and with an apparatus allowing, e.g., the clipping of a color code in the form of a circular disk.

According to a particular aspect shown in FIG. 4, the apparatus can receive support tongue 13 by clipping, that represents the second degree of the security level.

Figure 5:
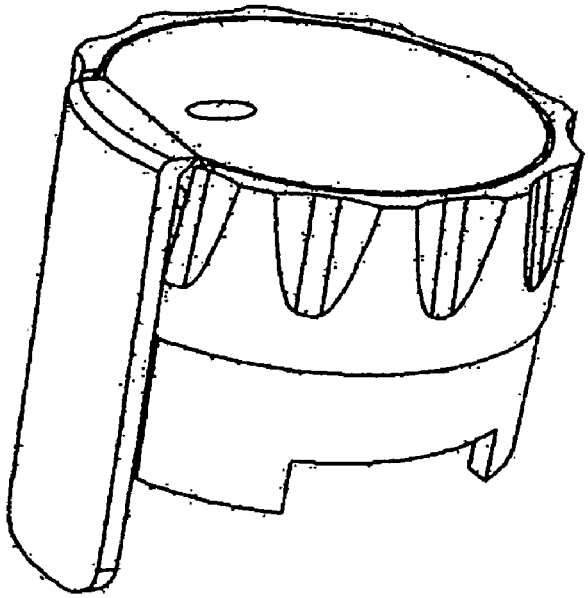
FIG. 5 shows a plug associated with a securement sleeve provided with a security tongue in a closed position.

Moreover, the plug has passage undercut 14 for permitting the passage without excess thickness of the tongue in closed position as in FIG. 5.

Furthermore, the plug may comprise an internal clipping part in its interior suitable for receiving accessories for the manipulation of the specimens directly in the interior of the tube, e.g., to facilitate the extraction of specimens and their use.

Finally, it also comprises on its lower part housing 15 for receiving first-degree divisible securement clamp 11 in interlocked position.

The unit "tube-sleeve-plug-" is used for purposes of the securement and manipulation of specimens. The methods of use can then be a function of the level of security required.

Figure 6:
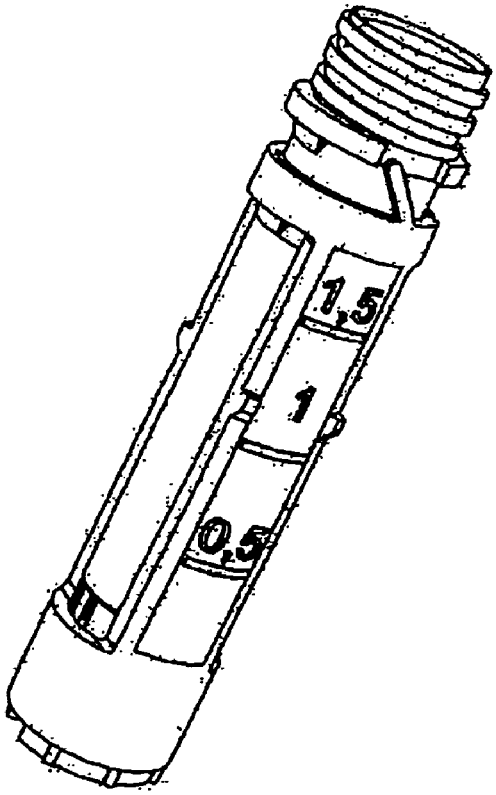
FIG. 6 shows interlocking of a tube in a sleeve according to a first catch (notch)

According to one method of use in the case of a standard laboratory, the plug is screwed on the tube and the sleeve interlocked on first catch 3 as in FIG. 6. The user can then unscrew the plug, place the specimen inside the tube, screw the plug back on and engage the first degree of inviolability himself by interlocking second catch 4 as in FIG. 7.

It can be noted that in this method of use the sterility level of the tube is guaranteed by the supplier of the tube. On the contrary, after the interlocking on the second catch, any opening of the tube will bring about the breaking of divisible clamp 11 and will be noticed, as in FIG. 8.

Figure 7:
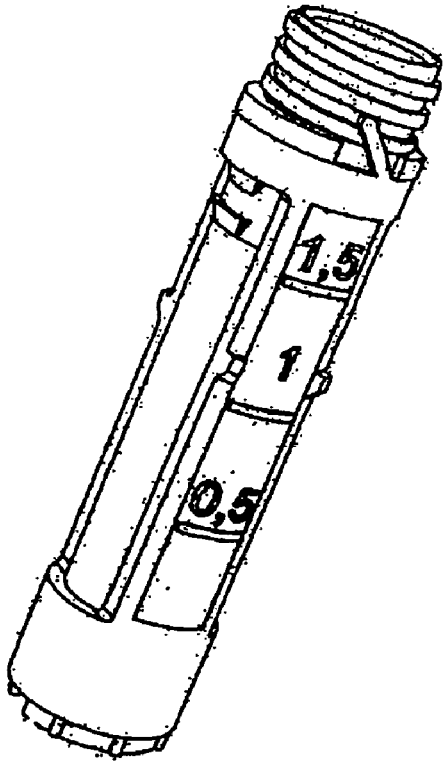
FIG. 7 shows interlocking of a tube in a sleeve according to another catch.

According to another selected method of use in the case of tubes for use in forensic medicine, the user receives the plug apparatus closed with second catch 4 interlocked as in FIG. 7, which guarantees the emptiness and a sterility level before any usage in the instance in which divisible clamp 11 is intact.

Figure 9:
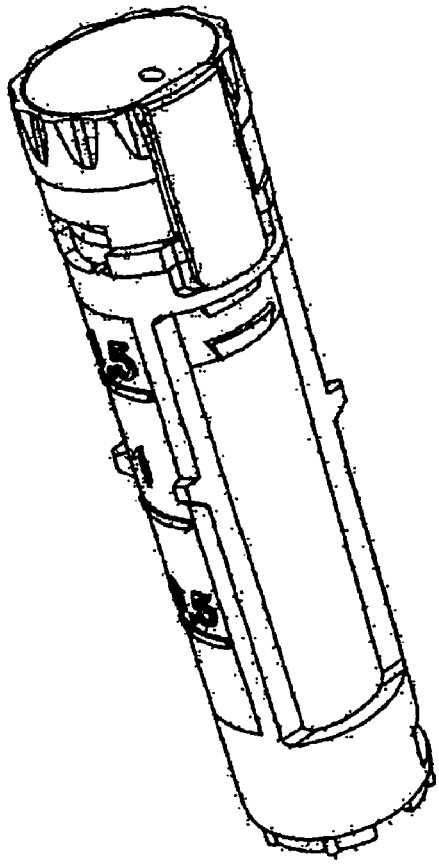
FIG. 9 shows a sleeve after placement of a security tongue.

After use and the introduction of the specimens into the tube, the inviolability is ensured by the second-level security apparatus with the aid of tongue 13 integrated conjointly with the sleeve and the plug as in FIG. 9.

The device was described above by way of example. It is understood that one skilled in the art is capable of realizing different variants without departing from the scope of the appended claims.

The invention claimed is:

1. A unit that receives biological specimens comprising:

a sleeve;

a tube shaped and sized to contain biological specimens and to slide into the sleeve and provided with a system that interlocks the sleeve on the tube in first and second positions; and a plug;

wherein, after interlocking in the first position, the sleeve is irreversibly integrated to the tube and biological specimens can be inserted in the tube, and, after interlocking in the second position, accessing the biological specimens causes an irreversible and visible physical transformation of the sleeve, but not the plug.

2. The apparatus according to claim 1, wherein the plug and tube can be interlocked.

3. The apparatus according to claim 1, further comprising a connecting means integral with the sleeve.

4. The apparatus according to claim 3, wherein the connecting means is a divisible clamp.

5. The apparatus according to claim 3, wherein the physical transformation is a rupture or tear of the connecting means.

6. The apparatus according to claim 3, wherein the connecting means is a tongue that can be integrated in a definitive and non-replaceable manner with the sleeve and the plug.

7. The apparatus according to claim 6, wherein integration of the tongue is carried out with an adhesive band that can not be violated by tearing.

8. The apparatus according to claim 6, wherein integration of the tongue is carried out by welding.

9. The apparatus according to claim 1, wherein interlocking of the sleeve is made by irreversibly sliding the tube into the sleeve.

10. The apparatus according to claim 1, wherein the sleeve and the tube are made of different materials.

11. The apparatus according to claim 1, wherein the sleeve is composed of a material that allows engraving an indelible and unitary identification.

12. The apparatus according to claim 11, wherein the sleeve is composed of a material that allows reading of elevated engraving.

13. The apparatus according to claim 11, further comprising an insertable element containing at least one piece of information associated with contents of the tube.

14. The apparatus according to claim 13, wherein insertion is carried out without masking the identification engraving and in an irreversible manner.

15. The apparatus according to claim 13, wherein insertion is carried out without masking the identification engraving and in an irreversible manner.

16. The apparatus according to claim 13, wherein insertion is carried out in an irreversible manner.

17. A unit for receiving biological specimens comprising:

a tube shaped and sized to receive the biological specimens;

a sleeve provided with at least one breakable catch;

a plug;

wherein the tube comprises:

a first catch that integrates the sleeve to the tube in an irreversible manner; and a second catch such that, after interlocking of the second catch, subsequent opening of the tube causes irreversible and visible breakage of the breakable catch.

18. A unit for receiving biological specimens comprising:

a tube shaped and sized for receiving the biological specimens;

a sleeve comprising an interlocking system that interlocks the sleeve on the tube at first and second positions and an individual breakable clamp for each of the two positions, the rupture of which is irreversible and visible; and a plug;

wherein interlocking the sleeve at the first position irreversibly integrates the sleeve with the tube and removal of the plug irreversibly breaks the first clamp, allowing free movement of the plug, and wherein interlocking at the second position requires an irreversible and visible breakage of the second clamp for plug removal.

* * * * *